United States Patent [19]

Goddard et al.

[11] 4,138,282

[45] * Feb. 6, 1979

[54] HIGH BURNING RATE PROPELLANTS WITH COPRECIPITATED SALTS OF DECAHYDRODECABORIC ACID

[75] Inventors: Terrence P. Goddard, Aptos; Donald N. Thatcher, Hollister, both of Calif.

[73] Assignee: Teledyne McCormick Selph, Hollister, Calif.

[ * ] Notice: The portion of the term of this patent subsequent to Jan. 23, 1996, has been disclaimed.

[21] Appl. No.: 707,810

[22] Filed: Jul. 22, 1976

Related U.S. Application Data

[63] Continuation-in-part of Ser. No. 694,626, Jun. 10, 1976, which is a continuation-in-part of Ser. No. 585,216, Jun. 6, 1975, abandoned.

[51] Int. Cl.[2] ..... C01B 45/10

[52] U.S. Cl. ..... 149/19.8; 149/19.1; 149/19.3; 149/19.9; 149/22

[58] Field of Search ..... 149/19.2, 19.8, 19.9, 149/22, 19.1, 19.3, 19.4, 19.5, 19.6, 19.91

[56] References Cited

U.S. PATENT DOCUMENTS

| | | | |
|---|---|---|---|
| 3,126,305 | 3/1964 | Armstrong | 149/61 X |
| 3,148,938 | 9/1964 | Knoth | 149/22 X |
| 3,149,163 | 9/1964 | Knoth | 149/22 X |
| 3,256,056 | 6/1966 | Armstrong | 149/22 X |
| 3,617,403 | 11/1971 | Johnson | 149/22 X |
| 3,689,331 | 9/1972 | Pierce | 149/22 X |
| 4,002,681 | 1/1977 | Goddard | 260/564 D |

*Primary Examiner*—Edward A. Miller

*Attorney, Agent, or Firm*—David H. Semmes; Warren E. Olsen

[57] ABSTRACT

A class of high burning propellants, useful as gun or rocket propellants, gas generators or specialized application where a very high burning rate is required, characterized by replacing the normally found oxidizer used in various propellants with certain coprecipitated salts of decahydrodecaboric acid and certain oxidizing agents. The resultant propellants employ such a coprecipitate as the major faction of the solids loading, and optionally may further include certain simple decahydrodecaborate salts for further enhancement of the burning rates in the thusly formulated and composed propellants.

53 Claims, No Drawings

HIGH BURNING RATE PROPELLANTS WITH COPRECIPITATED SALTS OF DECAHYDRODECABORIC ACID

CROSS-REFERENCES TO RELATED APPLICATIONS

This application is a continuation-in-part of our copending application COPRECIPITATED PYROTECHNIC COMPOSITION PROCESSES AND RESULTANT PRODUCTS, Ser. No. 694,626, filed June 10, 1976, which in turn is a continuation-in-part of the application entitled HIGH BURN PROPELLANT COMPOSITIONS, Serial No. 585,216, filed June 6, 1975, and now abandoned.

This application is also a related case to our copending applications COMPOSITE PROPELLANTS INCORPORATING BURNING RATE ENHANCERS, Ser. No. 696,323, filed June 15, 1976, and ACTIVE BINDER PROPELLANTS INCORPORATING BURNING RATE CATALYSTS, Ser. No. 696,324, filed June 15, 1976.

BACKGROUND AND SUMMARY OF THE INVENTION

The present invention describes a class of propellants useful as gun or rocket propellants, gas generators, or specialized applications where a very high burning rate is required. The key ingredient of the propellant compositions is a coprecipitate of selected metallic and nonmetallic salts of decahydrodecaboric acid, in combination with certain oxidizing agents. The method of preparing the coprecipitates results in chemical substances in which there is intercrystalline mixing of the substituents, in a chemical state not obtainable by physical blending.

The forementioned coprecipitates replace the oxidizer normally found in typical compositions such as composite propellants, and are responsible for the high burning rates. Other simple decahydrodecaborate salts of selected types, and either soluble or insoluble in the propellant resins or extending solvents, may optionally be additionally used to further enhance the burning rate.

The subject propellants have the general formula as follows:

| | Probable Range, % by Wt. |
|---|---|
| 1. Polymeric binder system | 8–35 |
| 2. Curing, polymerizing, or cross-linking agents | 0–10 |
| 3. Plasticizing agents | 0–25 |
| 4. Decahydrodecaborate compounds Class (1) | 0–25 |
| 5. Decahydrodecaborate compounds Class (2) | 35–90 |
| 6. Energetic fuels, such as, but not limited to, finely divided aluminum | 0–10 |
| 7. Oxidizer or mixture of oxidizers to supplement (5) | 0–15 |
| 8. Other inert ingredients, such as colorants, stabilizers. | 0–10 |

The ingredients, selected from items (3) through (8) in the above list, are combined in a suitable manner with a binder system selected from items (1) and (2) to form a nonporous propellant with desired physical properties. The key ingredient which distinguishes the subject propellants from other state-of-the-art propellants is the use of decahydrodecaborate compounds (item 5) of class (2), as further defined and described hereinafter. The optional and additional use of decahydrodecaborate compounds of class (1), as defined hereinafter, to enhance burning rate when used with certain "active," that is, oxygen or fluorine containing binders, is also unique.

The two classes of decahydrodecaborate compounds as defined as follows:

Class 1

The simple decahydrodecaborate salts used according to the first class of burn rate enhancers within the present invention are compounds of the general chemical formula:

$$M_x(B_{10}H_{10})_y$$

where M is a cation or complex cation incorporating hydrogen, nitrogen, carbon, or metals, or some combination thereof, and is chosen from the list given below; x is the number of M ions; and y is equal to:

$$\frac{x \text{ times the valence of the } M \text{ ion}}{2}$$

The compounds may further be defined as salts of decahydrodecaboric acid, and thus contain as a common ion the decahydrodecaborate (−2) anion $B_{10}H_{10}^{-2}$.

The cation M is chosen from the classes:

(a) ammonium, $NH_4^+$, wherein the salt has the formula $(NH_4)_2 B_{10}H_{10}$, and is described by KNOTH U.S. Pat. No. 3,148,938.

(b) hydrazinium, $NH_2NH_3^+$, wherein the salt has the formula $(NH_2NH_3)_2B_{10}H_{10}$, and is described by KNOTH U.S. Pat. No. 3,148,938, (c) substituted ammonium cations, wherein the salt has the general formula $(R_3NH)_2B_{10}H_{10}$, where R can be hydrogen (H) or an alkyl radical (preferred radicals contain less than six (6) carbon atoms). The R's in the preceding formula may represent different alkyl groups. Compounds with two or three hydrogen radicals are described by KNOTH U.S. Pat. No. 3,149,163. Typical cations are mthylammonium $(CH_3)NH_3^+$, dimethylammonium $(CH_3)_2NH_2^+$, trimethylammonium $(CH_3)_3NH^+$, and triethylammonium $(CH_3CH_2)_3NH^+$.

(d) substituted hydrazinium cations, wherein the salt has the general formula $(R_2NNR_2H)_2B_{10}H_{10}$, where R can be hydrogen (H) or an alkyl radical (preferred radicals contain less than six (6) carbon atoms), and the substituted alkyl groups can be symmetric or assymmetric with respect to the N-N linkage. Symmetric substitutued cations are described by KNOTH U.S. Pat. No. 3,149,163. An example of an unsymmetric substituted cation is (1,1) dimethylhydrazinium. The R's in the preceding formula may be mixed alkyl radicals.

(e) quaternary ammonium salts of the general formula $(R_4N)_2B_{10}H_{10}$, where R is an alkyl radical; the R,s in the preceding formula may represent mixed alkyl groups. Examples of typical cations are tetramethylammonium $(CH_3)_4N^+$ and tetraethylammonium $(CH_3CH_2)_4N^+$.

(f) aryl containing cations, such a pyrididinium, bipyridinium, or substituted aryl cations, such as aryldiazonium cations.

(g) guanidinium ion, $C(NH_2)_3^+$, wherein the salt has the formula $(C(NH_2)_3)_2B_{10}H_{10}$, and is described in the copending application of common assignment, entitled BIS-GUANIDINIUM DECAHYDRODECABORATE AND A PROCESS FOR ITS PREPARA- TION, filed June 10, 1976, and assigned Ser. No. 694,627.

(h) metal ions, derived from metals defined by a Periodic Table such as that in the "Handbook of Chemistry and Physics", 54th Edition, inside front cover, by the elements in Groups 1, 2, 8, 3*b*, 4*b*, 5*b*, 6*b* and 7*b*, and the elements of Groups 3*a*, 4*a*, 5*a*, and 6*a* with atomic numbers greater than 5, 14, 33, and 52 respectively. The metal decahydrodecaborate salts are further described by KNOTH U.S. Pat. No. 3,148,939. Examples of such metals salts are $Cs_2B_{10}H_{10}$ and $K_2B_{10}H_{10}$, the cesium and potassium salts of decahydrodecaboric acid, which are representative of alkaline metal decahydrodecaborate salts, having atomic numbers less than 87, preferred for the compositions described in this invention.

The salts of the decahydrodecaborate (−2) ion (Chemical formula $B_{10}H_{10}^{-2}$) are conveniently prepared by stoichiometrically reacting an aqueous solution of the parent acid, dihydrogen decahydrodecaborate, $H_2B_{10}H_{10}$, with (1) a soluble hydroxide of the desired cation, such as ammonium hydroxide, (2) the conjugate Bronsted base of the desired cation, such as a free amine, or (3) a soluble salt of the desired cation, such that the salt anion is destroyed during the reaction, such as guanidine carbonate. A Bronsted base is any substance capable of accepting a proton in a reaction; the definition is elaborated upon in any elementary chemistry text, such as Dickerson, Gray and Haight, "Chemical Principles, 2nd Edition," 1974, page 135.

The aqueous solutions of the salts, prepared above, may be evaporated to dryness to recover the crystalline salt. Alternatively, some salts may be precipitated from the aqueous solution by a nonsolvent that is miscible with water. The salts may be purified by recrystallization.

The aqueous decahydrodecaboric acid used as a starting material for the process of this invention is conveniently prepared by passing an amine or metal salt of the decahydrodecaborate (−2) ion through a column containing a strongly acidic ion exchange resin of the sulfonic acid type, such as a DUOLITE type "C-20", acid form by the Diamond Shamrock Corporation. Preferred starting salts are bis(triethylammonium) decahydrodecaborate (−2) and disodium decahydrodecaborate (−2). The preparation and properties of the aqueous acid, and additional preparative methods for metallic salts, are described in more detail in U.S. Pat. No. 3,148,939.

CLASS 2

An intimate blend of the compounds described in Class (1) above, with an oxidizing agent, in a manner that a chemically and physically different product is obtained than the starting materials.

The process by which the compositions of this class are prepared produces a very intimate blend of decahydrodecaborate (−2) ion with the oxidizer and makes the compositions so prepared chemically and physically unique from physical blends of decahydrodecaborate (−2) salts with oxidizer or pyrotechnic compositions incorporating decahydrodecaborate (−2) salts produced by other means. In general, the process consists of dissolving, in a suitable solvent, a decahydrodecaborate (−2) salt, as described above, and also dissolving, in the same solution, an oxidizing agent, as described above. The subject composition is recovered by precipitating the composite ingredients of the solution with a suitable nonsolvent. The resulting solid, after filtration and drying, comprises an intimate mixture of the decahydrodecaborate (−2) anion with the oxidizing cation or substance, in a form that is chemically and physically different than the starting materials.

The process may be properly called a "cocrystallization" or "coprecipitation" and the resulting product a "cocrystallate" or "coprecipitate".

An essential component of Class (2) compounds is an oxidizing agent; i.e., a material that will readily react or burn when mixed with the decahydrodecaborate (−2) salt. Any solid oxidizing agent which will yield oxygen upon decomposition will fulfill this role; solid oxygen containing metal or nonmetal salts are preferred because of their availability, stability, and ease of incorporation into the composition.

In general, solid oxidizing agents include ammonium, substituted ammonium, guanidine, substituted guanidine, alkali and alkaline-earth salts of oxygen containing acids such as nitric, perchloric, permanganic, manganic, chromic, and dichromic acids. Preferred species for this invention, which gave good thermal stability and low hygroscopicity include ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate. Other solid oxidizing agents which could be used if the appropriate solvent/nonsolvent system were used include ammonium, substituted ammonium, guanidine, substituted guanidine, alkali and alkaline-earth salts of other oxygen-containing acids such as chloric, persulfuric, thiosulfuric, periodic, iodic and bromic acids. Other stable oxides include lead thiocyanate, the oxides and peroxides of the light and heavy metals and nonmetals, such as barium peroxide, lead peroxide ($PbO_2$), lithium peroxide, ferric oxide, red lead ($Pb_3O_4$), cupric oxide, tellurium dioxide, antimonic oxide, etc., and nonionic substances such as nitrocellulose, nitroguanidine, and cyclotetramethylenetetranitramine (HMX). Mixtures of the aforementioned oxidizing agents also can be used.

These unique coprecipitated Class 2 salts, containing the $B_{10}H_{10}^{-2}$ anion, and the process for their creation, are themselves further disclosed in our copending patent application entitled COPRECIPITATED PYROTECHNIC COMPOSITION PROCESSES AND RESULTANT PRODUCTS, filed June 10, 1976, assigned Ser. No. 694,626, which is incorporated herein by reference.

The compositions of this invention make use of the unique decomposition properties of the decahydrodecaborate (−2) ion, a bicapped square antiprism polyhedral ion with unusual stability; the ion is believed to be kinetically rather than thermodynamically stabilized. The ion demonstrates an unusually fast decomposition upon oxidation, which is believed to proceed through the labile apical hydrogen atoms bonded to the cage. When incorporated into a composition such as a propellant, the decahydrodecaborate (−2) ion acts in such a manner as to control the overall burning rate of the propellant, so that the overall composition exhibits an accelerated, and in some cases, a stabilized burning rate.

The propellant binder system may be of a polymeric type which requires a post formulation cure, such as polyester, polybutadiene system, or alternatively, may be a polymer, such as nitrocellulose, which requires no additional crosslinking to give the desired properties.

Polymeric binder systems requiring a cure may be based on, but are not limited to, resins of the following types: polyester, polyacrylate, epoxy, polysulfide, polyurethane, the copolymer of butadiene and acrylic acid (PBAA), the terpolymer of butadiene, acrylic acid, and acrylonitrile (PBAN), carboxy-terminated polybutadiene (CTPB), hydroxy-terminated polybutadiene (HTPB).

Nitrocellulose binder does not require a post formulation cure. Nitrocellulose of nitrogen content between 12.5 and 13.3% nitrogen content is preferred. The nitrocellulose binder system is an example of an "active binder", that is, one which is self-combusting and contributes per se to the overall performance.

As used herein, a nitrocellulose binder would be used in such relatively low percentages, e.g., 8% to less than 35%, as noted above, that it would not constitute a "single base" propellant. Unlike our copending Ser. No. 696,324, ACTIVE BINDER PROPELLANTS INCORPORATING BURNING RATE CATALYSTS, noted hereinbefore, the present invention substantially replaces the normally found oxidizer component in a propellant withe the coprecipitate of an oxidizer and a decahydrodecaborate salt. Hence, the present invention is distinguished in that the coprecipitation of a decahydrodecaborate salt with an oxidizer becomes substantially all the oxidizer necessary in the subject propellants.

As used hereinabove, the well known term "cure" includes a chemical reaction wherein monomers are either cross-linked or end-linked. Of course, nitrocellulose is a natural polymer that does not require any type of cure.

Binders incorporating fluorine are also preferred species for the subject invention. Examples of suitable resins are the copolymer of hexafluoropropylene and vinylidene fluoride, and the copolymer of chlorotrifluoroethylene and vinylidene. The former copolymer is an example of a fluorine containing binder which may be used with or without a curing agent; a suitable curing system consists of 5 to 10 parts-by-weight zinc oxide, 5 to 10 parts-by-weight dibasic lead phosphate, and 1.5 to 3.0 parts-by-weight benzoyl peroxide or 3 parts-by-weight polyamine such as hexamethylenediamine to 100 parts-by-weight copolymer resin.

Other ingredients useful, but not essential, in the subject invention, include fuels, such as finely divided aluminum, to enhance the flame temperature of the burning propellant, additional oxidizer, such as ammonium or potassium perchlorate, to achieve more complete combustion of the binder; plasticizers, such as difunctional or trifunctional epoxy resins (uncured) and organic esters, which modify the resulting physical properties of the propellant; and other additives such as colorants, stabilizers, etc. All of the forementioned ingredients and their usage are practiced and known to those experienced in the art.

The method of manufacture and subsequent processing of the propellant to the desired configuration, is dependent upon the specific formulation and configuration desired for an intended usage. In general, the formulations of this invention may be cast, extruded, or pressed, depending on the end-of-mix (before curing, if any) properties.

Representative formulations according to the principles of the present invention are detailed, as follows:

Example I illustrates the invention with a propellant binder that is representative of "composite" propellants, as known in the art and also defined in our copending application COMPOSITE PROPELLANTS INCORPORATING BURNING RATE ENHANCERS, Ser. No. 696,323, filed June 15, 1976. Example I further illustrates a coprecipitation compound which is representative of the coprecipitation of a class (1) metallic salt of decahydrodecaborate acid with an oxidizer. The coprecipitate of cesium decahydrodecaborate with potassium nitrate is intended to be representative of most class (2) metallic salt coprecipitations with appropriate and conventional oxidizers.

EXAMPLE I 33.8 grams of a hydroxy-terminated polybutadiene polymer resin (R45M, Arco Chemical Co., Lakewood, CA), 20.0 grams of isodecyl pelargonate (Emery 2911, Emergy Industries, Inc., Cincinatti, Ohio) and 25.0 grams powdered aluminum are charged into a Baker Perkins 1 pint sigma blade mixer, and degassed under vacuum at 190° F. for 1 hour. The temperature is reduced to 140° F. 182.5 grams of the coprecipitate of 25 parts-by-weight cesium decahydrodecaborate and 75 parts-by-weight potassium nitrate is added to the mixer in 5 increments; mixing under vacuum is continued for a minimum of 10 minutes after each addition. 2.87 grams of the curing agent toluene dissocyanate is added and mixing continued for 10 minutes.

A tough rubbery nonporous material is obtained after a 24 hour ambient cure. Burning rate strands ¼ inch square and 1½ inches long are cut from slabs of the propellant.

The cured strands are inhibited with a single layer of carboxy-terminated polybutadiene rubber, and cured at 190° F. for 24 hours minimum. A second layer of 35% Shell Epon 828 epoxy resin and 65% polyamine curing agent is added over the CTPB inhibitor, and cured for a minimum of 2 hours at 190° F.

The cured and inhibited strands are tested as follows: The burn rate strands are trimmed to a length of approximately 1½ inches. A nichrome ignition wire is inserted through a 1/16 inch hole drilled ¼ inch from one end of the strand.

Two lacquer-coated solder breakwires are inserted through 1/16 inch holes spaced 1 inch apart and ¼ inch from the ignition wire; the breakwires are potted into place with nitrocellulose cement. The strand with attached wires is securely fastened with phenolic tiedowns to a phenolic plate, and electrical connections to the wires made. The phenolic plate is mounted in a pressure bomb; electrical connections are made through a feedthrough mounted in the bomb flange. For testing, a sealed bomb is first pressurized to 1000, and then another test is made at 2000 psi. A 28V pulse applied to the ignition wire ignites the strand. Time between successive breakwire breaks is recorded, as well as pressure rise in the bomb as a function of time. The reciprocal of the time between successive wire breaks is the burn rate in inches per second. The average of the burn rates over the manifold of data points for several strands of the propellant is taken as the burn rate for the propellant.

When tested in the above manner, the propellant exhibits a linear burning rate of 12.1 ± 0.7 inches per second at 1000 psi and 16.3 ± 1.9 inches per second at 2000 psi.

The next example, Example II, illustrates the performance of the same representative class (2) metallic coprecipitate, cesium decahydrodecaborate with potassium nitrate, with a nitrocellulose binder. The nitrocellulose binder typifies an "active" binder, and the effects of varying the relative weights of an active binder and a representative coprecipitate is illustrated.

EXAMPLE II

Propellants incorporating coprecipitated cesium decahydrodecaborate and potassium nitrate in a nitrocellulose binder are prepared according to Table I, in nominal 100–200 gram batch sizes, as follows:

TABLE I

| Ingredient | By Weight Propellant 2 | Propellant 3 | Propellant 4 |
|---|---|---|---|
| Nitrocellulose (12.6% N) | 17.0 | 12.8 | 13.0 |
| Dinitrotoluene | 12.0 | 14.5 | 6.5 |
| Acetyl tributyl citrate | 10.0 | 8.6 | 5.5 |
| Coprecipitate of cesium decahydrodecaborate and potassium nitrate, 25/75 ratio, parts-by-weight | 61.0 | 64.1 | 75.0 |

Nitrocellulose, of nitrogen content 12.6%, and corresponding to that material specified as MIL-N-244A, Grade A Type I, is dissolved in reagent grade acetone, in the approximate ratio of 1 part nitrocellulose to 5 parts acetone using a magnetic stirrer and teflon spin bar. The dinitrotoluene and acetyl tributyl citrate are added to the nitrocellulose/acetone solution and mixing continued until the ingredients are completely mixed, 10 minutes being an adequate period.

The resulting solution is charged into a Baker Perkins 1 pint sigma blade mixer at 60° C. The coprecipitate of cesium decahydrodecaborate and potassium nitrate is added in three equal increments, with a minimum of 10 minute mixing between additions. Mixing is continued until a uniform slurry of mixed ingredients is obtained. Vacuum is applied (28 inches mercury minimum) to the mixer and mixing continued, usually for several hours, until the material has a tough, rubbery consistency.

Burning rate strands are prepared from the warm propellant by placing into a small extruder and extruding a ⅛ inch strand with the help of an air operated press. The material can also be rolled into thin sheets, or pressed into a variety of grain configurations.

The ⅛ inch O.D. strands are dried for two days minimum in an oven at 60° C. to remove residual acetone.

A sample of the propellants are subjected to an impact or "drop" test consisting of dropping a 2 kg weight from a calibrated height onto a small (20 milligram) sample of propellant placed on a grit base. The propellant cannot be ignited in 10 trials when the weight is released from a height of 10 cm, which is indicative that the propellant is relatively insensitive and quite safe to handle.

The dried burning rate strands are coated with a single layer of flexible epoxy, simply to inhibit surface burning. The inhibited burn rate strands are cut to a length of approximately 3½ inches. A nichrome ignition wire is inserted through a 1/16 inch hole drilled ½ inch from one end of the strand. Three lacquer-coated solder breakwires are inserted through 1/16 inch holes spaced at 1 inch intervals from the ignition wire; the breakwires are potted into place with a nitrocellulose base cement such as Duco brand. The strand with attached wires is securely fastened with phenolic tiedowns to a phenolic plate, and electrical connections to the wires made.

The phenolic plate is mounted in a pressure bomb; electrical connections are made through a feedthrough mounted in the bomb flange. The sealed bomb is first pressurized to 1000, and then to 2000 psi. A 28V pulse applied to the ignition wire ignited the strand. Time between successive breakwire breaks is recorded, as well as pressure rise in the bomb as a function of time. The reciprocal of the time between successive wire breaks is the burn rate in inches per second. The average of these burn rates (2 data points per strand) over the manifold of data points for all strands of a particular propellant is taken as the burn rate for that propellant.

The burning rates obtained are as follows:

| | Linear Burning Rate Inches per Second 1000 psi | 2000 psi |
|---|---|---|
| Propellant 2 | 2.7 | 5.1 |
| Propellant 3 | 3.2 | — |
| Propellant 4 | 3.9 | 7.3 |

The data indicate the control that can be achieved by varying the concentration of the decahydrodecaborate coprecipitate. The pressure exponent of the propellant is approximately 0.9.

The next example, Example III, illustrates the same representative active binder of nitrocellulose, of a 12.6% nitrogen content, with a representative class 2 metallic coprecipitate, as in Example II and also with a representative class 2 nonmetallic salt of decahydrodecaborate acid which has been coprecipitated with an oxidizer. Propellant 6 employs tetramethylammonium decahydrodecaborate and typifies the results expectable when a simple nonmetallic salt, from class 1, as above-defined, is coprecipitated with potassium nitrate, or any equivalent oxidizer material.

EXAMPLE III

Propellants incorporating coprecipitated decahydrodecaborates and potassium nitrate, an acetone soluble simple decahydrodecaborate salt, and a nitrocellulose binder, are prepared according to Table II, in nominal 100g batches, as follows:

TABLE II

| Ingredients | % by weight Propellant 5 | Propellant 6 |
|---|---|---|
| nitrocellulose (12.6% N) | 17.0 | 17.0 |
| dinitrotoluene | 12.0 | 12.0 |
| acetyl tributyl citrate | 10.0 | 10.0 |
| potassium decahydrodecaborate | 16.0 | 16.0 |
| coprecipitate of cesium decahydrodecaborate and potassium nitrate, 25/75 ratio, parts-by-weight | 45.0 | |
| coprecipitate of tetramethylammonium decahydrodecaborate and potassium nitrate, 15/85 ratio, parts-by-weight. | | 45.0 |

The nitrocellulose, of nitrogen content 12.6%N, and corresponding to that material specified by MIL-N-244A, Grade A Type I, is dissolved in reagent grade acetone, in the approximate ratio 10 parts-by-weight acetone to 1 part nitrocellulose in a Waring blender operated at moderate speed. The potassium decahydrodecaborate salt is dried in vacuum for a minimum of 24 hours at 100° C. and dissolved in acetone in the approximate ratio 5 parts acetone to 1 part salt. The salt/acetone solution, dinitrotoluene, and acetyl tributyl citrate, are added to the blender and mixed for a minimum of 5 minutes, until a uniform fluid is obtained. The decahydrodecaborate coprecipitate is added to the blender in 3 increments, with blending of 5 minutes between additions, until a uniform slurry is obtained.

The resulting slurry is charged into a Baker Perkins 1 pint sigma blade mixer at 60° C. Vacuum is applied, and mixing started, to remove the acetone carrier. Mixing is continued, usually for a period of 4–8 hours, until a tough, rubbery dough is obtained.

Burning rate strands are prepared from the warm propellant by placing into a small extruder and extruding a ¼ inch strand with the help of an air operated press. The material can also be rolled into thin sheets, or pressed into a variety of grain configurations.

The ¼ inch O.D. strands are dried for two days minimum in an oven at 60° C. to remove residual acetone.

A sample of the propellants are subjected to an impact or "drop" test consisting of dropping a 2 kg weight from a calibrated height onto a small (20 milligram) sample of propellant placed on a grit base. The propellant cannot be ignited in 10 trials when the weight is released from a height of 7 cm, which is indicative that the propellant is relatively insensitive and quite safe to handle.

The dried burning rate strands are coated with a single layer of flexible epoxy to inhibit surface burning.

The inhibited burn rate strands are cut to a length of approximately 3½ inches. A nichrome ignition wire is inserted through a 1/16 inch hole drilled ½ inch from one end of the strand. Three lacquer-coated solder breakwires are inserted through 1/16 inch holes spaced at 1 inch intervals from the ignition wire; the breakwires are potted into place with a nitrocellulose base cement. The strand with attached wires is securely fastened with phenolic tiedowns to a phenolic plate, and electrical connections to the wires made. The phenolic plate is mounted in a pressure bomb; electrical connections are made through a feedthrough mounted in the bomb flange. The sealed bomb is pressurized, first to 1000, and then to 2000 psi. A 28V pulse applied to the ignition wire ignites the strand. Time between successive breakwire breaks is recorded, as well as pressure rise in the bomb as a function of time. The reciprocal of the time between successive wire breaks is the burn rate in inches per second. The average of these burn rates (2 data points per strand) over the manifold of data points for all strands of a particular propellant is taken as the burn rate for that propellant.

The burning rates obtained are as follows:

| | Linear Burning Rate Inches Per Second | |
|---|---|---|
| | 1000 psi | 2000 psi |
| Propellant 5 | 10.3 | 15.9 |
| Propellant 6 | 5.9 | — |

The data illustrates the burning rate enhancement that can be achieved by the addition of a soluble decahydrodecaborate salt to the propellant. Propellant 5 exhibits a pressure exponent of 0.6.

The following example, Example IV, illustrates the performance level of an active binder propellant according to the present invention, together with an optional, additional ingredient for burn rate enhancement. The optional use of certain simple salts of decahydrodecaboric acid, defined earlier herein as class (1) compounds, has been found useful with active binders in formulations as taught herein.

EXAMPLE IV

A propellant incorporating a coprecipitated decahydrodecaborate compound with oxidizer, a soluble simple decahydrodecaborate salt, and a fluorine containing polymeric binder is prepared according to Table III. The fluorine containing polymer is an example of a high energy binder, which contributes substantially to the speed and output of the overall reaction. No curing agent is used in this particular example, but a curing system utilizing a peroxide or amine cure, and comprising approximately 5% by weight of the total propellant weight, could be used to improve the physical properties of the propellant.

The copolymer of hexafluoropropylene and vinyldiene fluoride is dissolved in reagent grade acetone, in the approximate ratio 5 parts-by-weight acetone to 1 part-by-weight copolymer in a Waring blender. The potassium decahydrodecaborate salt is dried in vacuuo for a minimum of 24 hours at 100° C., and dissolved in acetone in the approximate ratio 5 parts acetone to 1 part salt. The salt/acetone solution is added to the blender and mixed for several minutes until a homogenous mix is obtained. The decahydrodecaborate coprecipitate is added to the blender in 3 increments, with blending of 5 minutes between additions, until a uniform slurry is obtained.

TABLE III

| Ingredient | % By Weight Propellant 7 |
|---|---|
| Copolymer of hexafluoropropylene and vinyldiene fluoride (1) | 25.0 |
| Coprecipitate of cesium decahydrodecaborate and potassium nitrate, 25/75 parts-by-weight | 65.0 |
| Potassium decahydrodecaborate | 10.0 |

(1) "Fluorel" Brand Elastomer FC-2175 (3M Company, St. Paul, Minn.)

The resulting slurry is charged into a Baker Perkins 1 pint sigma blade mixer at 60° C. Vacuum is applied, and mixing started, to remove the acetone carrier. Mixing is continued, usually for a period of 4–8 hours, until a tough, rubbery dough is obtained.

Burning rate strands are prepared from the warm propellant by placing into a small extruder and extruding a ¼ inch strand with the help of an air operated press. The material can also be rolled into thin sheets, or pressed into a variety of grain configurations.

The ¼ inch O.D. strands are dried for two days minimum is an oven at 60° C. to remove residual acetone.

The dried burning rate strands are coated with a single layer of flexible epoxy to inhibit surface burning. The inhibited burn rate strands are cut to a length of approximately 3½ inches. A nichrome ignition wire is inserted through a 1/16 inch hole drilled ½ inch from one end of the strand. Three lacquer-coated solder breakwires are inserted through 1/16 inch holes spaced at 1 inch intervals from the ignition wire; the breakwires are potted into place with a nitrocellulose base cement. The strand with attached wires is securely fastened with phenolic tiedowns to a phenolic plate, and electrical connections to the wires made. The phenolic plate is mounted in a pressure bomb; electrical connections are made through a feedthrough mounted in the bomb flange. The sealed bomb is pressurized to 1000 psi. A 28V pulse applied to the ignition wire ignites the strand. Time between successive breakwire breaks is recorded, as well as pressure rise in the bomb as a function of time.

The reciprocal of the time between successive wire breaks is the burn rate in inches per second. The average of these burn rates (2 data points per strand) over the manifold of data points for all strands of a particular propellant is taken as the burn rate for that propellant.

When tested in the above manner, propellant 7 gives a burning rate of 16.7 inches per second at 1000 psi.

Though representative examples have been given to illustrate our invention, the scope of our invention is to be defined by the appended claims.

We claim:

1. A propellant composition wherein substantially all the oxidizer is physically intertwined by a coprecipitation with certain simple decahydrodecaborate salts, comprising, by weight:

(A) a polymeric binder system, in the range 8–35 percent;

(B) curing agents, in the range 0–10 percent;

(C) plasticizing agents, in the range 0–25 percent;

(D) the resultant product, in the range 35–90 percent, of a process wherein a solid oxidizing agent is coprecipitated with certain simple decahydrodecaborate salts, having the common anion $B_{10}H_{10}^{-2}$, wherein the cation is selected from the group consisting of:

(a) ammonium, wherein the salt has the formula $(NH_4)_2B_{10}H_{10}$;

(b) hydrazinium, wherein the salt has the formula $(NH_2NH_3)B_{10}H_{10}$;

(c) substituted ammonium cations, wherein the salt has the general formula $(R_3NH)_2B_{10}H_{10}$, wherein further R is selected from the group consisting of hydrogen and alkyl radicals containing less than six carbon atoms;

(d) substituted hydrazinium cations, wherein the salt has the general formula $(R_2NNR_2H)_2B_{10}H_{10}$ wherein further R is selected from the group consisting of hydrogen and alkyl radicals containing less than six carbon atoms, wherein said process comprises the steps of:

(i) dissolving both the decahydrodecaborate (−2) salt and the oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonsolvent fluid;

(iv) drying the product to remove all remaining liquid.

2. A propellant composition wherein substantially all the oxidizer is physically intertwined by a coprecipitation with certain simple decahydrodecaborate salts, comprising, by weight:

(A) a polymeric binder system, in the range 8–35 percent;

(B) curing agents, in the range 0–10 percent;

(C) plasticizing agents, in the range 0–25 percent;

(D) the resultant product, in the range 35–90 percent, of a process wherein a solid oxidizing agent is coprecipitated with certain simple decahydrodecaborate salts, having the common anion $B_{10}H_{10}^{-2}$, wherein the cation is selected from the group consisting of:

(a) tetramethylammonium, $(CH_3)_4N^+$, tetraethylammonium, $(CH_3CH_2)_4N^+$, and quaternary ammonium cations having the general formula $R_4N^+$ where R is an alkyl radical;

(b) pyrididinium, bipyridinium aryl-diazonium, aryl containing cations and substituted aryl containing cations, wherein said process comprises the steps of:

(i) dissolving both the decahydrodecaborate (−2) salt and the oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonsolvent fluid;

(iv) drying the product to remove all remaining liquid.

3. A propellant composition wherein substantially all the oxidizer is physically intertwined by a coprecipitation with certain simple decahydrodecaborate salts, comprising, by weight:

(A) a polymeric binder system, in the range 8–35 percent;

(B) curing agents, in the range 0–10 percent;

(C) plasticizing agents, in the range 0–25 percent;

(D) the resultant product, in the range 35–90 percent, of a coprecipitation of a solid oxidizing agent with a simple decahydrodecaborate salt, having the anion $B_{10}H_{10}^{-2}$, wherein the cation is guanidinium, and the salt has the formula $(C(NH_2)_3)_2B_{10}H_{10}$, comprising the steps of:

(i) dissolving both the decahydrodecaborate (−2) salt and the oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonsolvent fluid;

(iv) drying the product to remove all remaining liquid.

4. A propellant composition wherein substantially all the oxidizer is physically intertwined by a coprecipitation with certain simple decahydrodecaborate salts, comprising, by weight:

(A) a polymeric binder system, in the range 8–35 percent;

(B) curing agents, in the range 0–10 percent;

(C) plasticizing agents, in the range 0–25 percent;

(D) the resultant product, in the range 35–90 percent, of a process wherein a solid oxidizing agent is coprecipitated with certain simple decahydrodecaborate salts, having the common anion $B_{10}H_{10}^{-2}$, wherein the cation is selected from the group consisting of metal ions derived from the elements in Groups 1, 2, 8, 3*b*, 4*b*, 5*b*, 6*b*, 7*b*, and the elements of Groups 3*a*, 4*a*, 5*a*, and 6*a* which have atomic numbers respectively greater than 5, 14, 33 and 52, wherein said process comprises the steps of:

(i) dissolving both the decahydrodecaborate (−2) salt and the oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonsolvent fluid;

(iv) drying the product to remove all remaining liquid.

5. A propellant composition wherein substantially all the oxidizer is physically intertwined by a coprecipitation with certain simple decahydrodecaborate salts, comprising, by weight:

(A) a polymeric binder system, in the range 8–35 percent;

(B) curing agents, in the range 0–10 percent;

(C) plasticizing agents, in the range 0–25 percent;

(D) the resultant product, in the range 35–90 percent, of a process wherein a solid oxidizing agent is coprecipitated with certain metallic salts, selected from the group consisting of cesium decahydrodecaborate, $Cs_2B_{10}H_{10}$, and potassium decahydrodecaborate, $K_2B_{10}H_{10}$, wherein said process comprises the steps of:

(i) dissolving both the decahydrodecaborate (−2) salt and the oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonsolvent fluid;

(iv) drying the product to remove all remaining liquid.

6. A propellant composition according to claim 1 wherein said resultant coprecipitation process product further comprises said solid oxidizer being selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

7. A propellant composition according to claim 2 wherein said resultant coprecipitation process product further comprises said solid oxidizer being selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

8. A propellant composition according to claim 3 wherein said resultant coprecipitation process product further comprises said solid oxidizer being selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

9. A propellant composition according to claim 4 wherein said resultant coprecipitation process product further comprises said solid oxidizer being selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

10. A propellant composition according to claim 5 wherein said resultant coprecipitation process product further comprises said solid oxidizer being selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

11. A propellant composition as in claim 6 wherein said polymeric binder system is a composite propellant requiring a post-formulation cure and is selected from the group consisting of:

polyester
polyacrylate,
epoxy,
polysulfide,
polyurethane,
the copolymer of butadiene and acrylic acid (PBAA),
the terpolymer of butadiene,
acrylic acid,
acrylonitrile (PBAN)
carboxy-terminated polybutadiene (CTPB) and
hydroxy-terminated polybutadiene (HTPB)

12. A propellant composition as in claim 7 wherein said polymeric binder system is a composite propellant requiring a post-formulation cure and is selected from the group consisting of:

polyester
polyacrylate,
epoxy,
polysulfide,
polyurethane,
the copolymer of butadiene and acrylic acid (PBAA),
the terpolymer of butadiene,
acrylic acid,
acrylonitrile (PBAN)
carboxy-terminated polybutadiene (CTPB) and
hydroxy-terminated polybutadiene (HTPB)

13. A propellant composition as in claim 8 wherein said polymeric binder system is a composite propellant requiring a post-formulation cure and is selected from the group consisting of:

polyester
polyacrylate,
epoxy,
polysulfide,
polyurethane,
the copolymer of butadiene and acrylic acid (PBAA),
the terpolymer of butadiene,
acrylic acid,
acrylonitrile (PBAN)
carboxy-terminated polybutadiene (CTPB) and
hydroxy-terminated polybutadiene (HTPB)

14. A propellant composition as in claim 9 wherein said polymeric binder system is a composite propellant requiring a post-formulation cure and is selected from the group consisting of:

polyester
polyacrylate,
epoxy,
polysulfide,
polyurethane,
the copolymer of butadiene and acrylic acid (PBAA),
the terpolymer of butadiene,
acrylic acid,
acrylonitrile (PBAN)
carboxy-terminated polybutadiene (CTPB) and
hydroxy-terminated polybutadiene (HTPB)

15. A propellant composition as in claim 10 wherein said polymeric binder system is a composite propellant requiring a post-formulation cure and is selected from the group consisting of:

polyester
polyacrylate,
epoxy,
polysulfide,
polyurethane,
the copolymer of butadiene and acrylic acid (PBAA),
the terpolymer of butadiene,
acrylic acid,
acrylonitrile (PBAN)
carboxy-terminated polybutadiene (CTPB) and
hydroxy-terminated polybutadiene (HTPB)

16. A propellant composition as in claim 6 wherein said polymeric binder system is selected from the group consisting of nitrocellulose, oxygen containing binders, and fluorine containing binders.

17. A propellant composition as in claim 7 wherein said polymeric binder system is selected from the group consisting of nitrocellulose, oxygen containing binders, and fluorine containing binders.

18. A propellant composition as in claim 8 wherein said polymeric binder system is selected from the group consisting of nitrocellulose, oxygen containing binders, and fluorine containing binders.

19. A propellant composition as in claim 9 wherein said polymeric binder system is selected from the group consisting of nitrocellulose, oxygen containing binders, and fluorine containing binders.

20. A propellant composition as in claim 10 wherein said polymeric binder system which is selected from the group consisting of nitrocellulose, oxygen containing binders, and fluorine containing binders.

21. A propellant composition as in claim 6 wherein said polymeric binder is an active binder selected from the group consisting of nitrocellulose, the copolymer of hexafluoropropylene and vinylidene fluoride, and the copolymer of chlorotrifluoroethylene and vinylidene fluoride.

22. A propellant composition as in claim 7 wherein said polymeric binder is an active binder selected from the group consisting of nitrocellulose, the copolymer of hexafluoropropylene and vinylidene fluoride, and the copolymer of chlorotrifluoroethylene and vinylidene fluoride.

23. A propellant composition as in claim 8 wherein said polymeric binder is an active binder selected from the group consisting of nitrocellulose, the copolymer of hexafluoropropylene and vinylidene fluoride, and the copolymer of chlorotrifluoroethylene and vinylidene fluoride.

24. A propellant composition as in claim 9 wherein said polymeric binder is an active binder selected from the group consisting of nitrocellulose, the copolymer of hexafluoropropylene and vinylidene fluoride, and the copolymer of chlorotrifluoroethylene and vinylidene fluoride.

25. A propellant composition as in claim 10 wherein said polymeric binder is an active binder selected from the group consisting of nitrocellulose, the copolymer of hexafluoropropylene and vinylidene fluoride, and the copolymer of chlorotrifluoroethylene and vinylidene fluoride.

26. A propellant composition according to claim 16 wherein said propellant composition further comprises from 0.01–25 percent, by weight, certain simple salts having the common anion $B_{10}H_{10}^{-2}$ wherein the cation is selected from the group consisting of:

(i) ammonium, wherein the salt has the formula $(NH_{42}B_{10}H_{10}$;
(ii) hydrazinium, wherein the salt has the general formula $(NH_2NH_3)\ B_{10}H_{10}$;
(iii) substituted ammonium cations, wherein the salt has the general formula $(R_3NH)_2B_{10}H_{10}$, wherein further R is selected from the group consisting of hydrogen and alkyl radicals containing less than six carbon atoms;
(iv) substituted hydrazinium cations, wherein the salt has the general formula $(R_2NNR_2H)_2B_{10}H_{10}$ wherein further R is selected from the group consisting of hydrogen and alkyl radicals containing less than six atoms;
(v) tetramethylammonium $(CH_3)_4N^+$, tetraethylammonium $(CH_3CH_2)_4N^+$, and quaternary ammonium cations having the general formula $R_4N^+$ where R is an alkyl radical;
(vi) pyrididinium, bipyridinium aryl-diazonium, aryl containing cations and substituted aryl containing cations;
(vii) guanidinium, wherein the salt has the formula $(C(NH_2)_3)_2B_{10}H_{10}$;
(viii) metal ions derived from the elements in Groups 1, 2, 8, 3*b*, 4*b*, 5*b*, 6*b*, 7*b*, and the elements of Groups 3*a*, 4*a*, 5*a*, and 6*a* which have atomic numbers respectively greater than 5, 14, 33 and 52.

27. A propellant composition according to claim 17 wherein said propellant composition further comprises from 0.01–25 percent, by weight, certain simple salts having the common anion $B_{10}H_{10}^{-2}$ wherein the cation is selected from the group consisting of:

(i) ammonium, wherein the salt has the formula $(NH_4)_2B_{10}H_{10}$;
(ii) hydrazinium, wherein the salt has the general formula $(NH_2NH_3)\ B_{10}H_{10}$;

(iii) substituted ammonium cations, wherein the salt has the general formula $(R_3NH)_2B_{10}H_{10}$, wherein further R is selected from the group consisting of hydrogen and alkyl radicals containing less than six carbon atoms;

(iv) substituted hydrazinium cations, wherein the salt has the general formula $(R_2NNR_2H)_2B_{10}H_{10}$ wherein further R is selected from the group consisting of hydrogen and alkyl radicals containing less than six atoms;

(v) tetramethylammonium $(CH_3)_4N+$, tetraethylammonium $(CH_3CH_2)_4N+$, and quaternary ammonium cations having the general formula $R_4N+$ where R is an alkyl radical;

(vi) pyrididinium, bipyridinium aryl-diazonium, aryl containing cations and substituted aryl containing cations;

(vii) guanidinium, wherein the salt has the formula $(C(NH_2)_3)_2B_{10}H_{10}$;

(viii) metal ions derived from the elements in Groups 1, 2, 8, 3*b*, 4*b*, 5*b*, 6*b*, 7*b*, and the elements of Groups 3*a*, 4*a*, 5*a*, and 6*a* which have atomic numbers respectively greater than 5, 14, 33 and 52.

28. A propellant composition according to claim 18 wherein said propellant composition further comprises from 0.01–25 percent, by weight, certain simple salts having the common anion $B_{10}H_{10}^{-2}$ wherein the cation is selected from the group consisting of:

(i) ammonium, wherein the salt has the formula $(NH_4)_2B_{10}H_{10}$;

(ii) hydrazinium, wherein the salt has the general formula $(NH_2NH_3)\ B_{10}H_{10}$;

(iii) substituted ammonium cations, wherein the salt has the general formula $(R_3NH)_2B_{10}H_{10}$, wherein further R is selected from the group consisting of hydrogen and alkyl radicals containing less than six carbon atoms;

(iv) substituted hydrazinium cations, wherein the salt has the general formula $(R_2NNR_2H)_2B_{10}H_{10}$ wherein further R is selected from the group consisting of hydrogen and alkyl radicals containing less than six atoms;

(v) tetramethylammonium $(CH_3)_4N^+$, tetraethylammonium $(CH_3CH_2)_4N^+$, and quaternary ammonium cations having the general formula $R_4N^+$ where R is an alkyl radical;

(vi) pyrididinium, bipyridinium aryl-diazonium, aryl containing cations and substituted aryl containing cations;

(vii) guanidinium, wherein the salt has the formula $(C(NH_2)_3)_3B_{10}H_{10}$;

(viii) metal ions derived from the elements in Groups 1, 2, 8, 3*b*, 4*b*, 5*b*, 6*b*, 7*b*, and the elements of groups 3*a*, 4*a*, 5*a*, and 6*a* which have atomic numbers respectively greater than 5, 14, 33 and 52.

29. A propellant composition according to claim 19 wherein said propellant composition further comprises from 0.01–25 percent, by weight, certain simple salts having the common anion $B_{10}H_{10}^{-2}$ wherein the cation is selected from the group consisting of:

(i) ammonium, wherein the salt has the formula $(NH_4)_2B_{10}H_{10}$;

(ii) hydrazinium, wherein the salt has the general formula $(NH_2NH_3)\ B_{10}H_{10}$;

(iii) substituted ammonium cations, wherein the salt has the general formula $(R_3NH)_2B_{10}H_{10}$, wherein further R is selected from the group consisting of hydrogen and alkyl radicals containing less than six carbon atoms;

(iv) substituted hydrazinium cations, wherein the salt has the general formula $(R_2NNR_2H)_2B_{10}H_{10}$ wherein further R is selected from the group consisting of hydrogen and alkyl radicals containing less than six atoms;

(v) tetramethylammonium $(CH_3)_4N^+$, tetraethylammonium $(CH_3CH_2)_4N^+$, and quaternary ammonium cations having the general formula $R_4N^+$ where R is an alkyl radical;

(vi) pyrididinium, bipyridinium aryl-diazonium, aryl containing cations and substituted aryl containing cations;

(vii) guanidinium, wherein the salt has the formula $(C(NH_2)_3)_2B_{10}H_{10}$;

(viii) metal ions derived from the elements in Groups 1, 2, 8, 3*b*, 4*b*, 5*b*, 6*b*, 7*b*, and the elements of Groups 3*a*, 4*a*, 5*a*, and 6*a* which have atomic numbers respectively greater than 5, 14, 33 and 52.

30. A propellant composition according to claim 20 wherein said propellant composition further comprises from 0.01–25 percent, by weight, certain simple salts having the common anion $B_{10}H_{10}^{-2}$ wherein the cation is selected from the group consisting of:

(i) ammonium, wherein the salt has the formula $(NH_{42}B_{10}H_{10}$;

(ii) hydrazinium, wherein the salt has the general formula $(NH_2NH_3)\ B_{10}H_{10}$;

(iii) substituted ammonium cations, wherein the salt has the general formula $(R_3NH)_2B_{10}H_{10}$, wherein further R is selected from the group consisting of hydrogen and alkyl radicals containing less than six carbon atoms;

(iv) substituted hydrazinium cations, wherein the salt has the general formula $(R_2NNR_2H)_2B_{10}H_{10}$ wherein further R is selected from the group consisting of hydrogen and alkyl radicals containing less than six atoms;

(v) tetramethylammonium $(CH_3)_4N^+$, tetraethylammonium $(CH_3CH_2)_4N^+$, and quaternary ammonium cations having the general formula $R_4N^+$ where R is an alkyl radical;

(vi) pyrididinium, bipyridinium aryl-diazonium, aryl containing cations and substituted aryl containing cations;

(vii) guanidinium, wherein the salt has the formula $(C(NH_2)_3)_2B_{10}H_{10}$;

(viii) metal ions derived from the elements in Groups 1, 2, 8, 3*b*, 4*b*, 5*b*, 6*b*, 7*b*, and the elements of Groups 3*a*, 4*a*, 5*a*, and 6*a* which have atomic numbers respectively greater than 5, 14, 33 and 52.

31. A propellant composition according to claim 11 wherein said polymeric composite propellant binder selected is hydroxy-terminated polybutadiene.

32. A propellant composition according to claim 12 wherein said polymeric composite propellant binder selected is hydroxy-terminated polybutadiene.

33. A propellant composition according to claim 13 wherein said polymeric composite propellant binder selected is hydroxy-terminated polybutadiene.

34. A propellant composition according to claim 14 wherein said polymeric composite propellant binder selected is hydroxy-terminated polybutadiene.

35. A propellant composition according to claim 15 wherein said polymeric composite propellant binder selected is hydroxy-terminated polybutadiene.

36. A propellant composition as in claim 21 wherein said binder selected is nitrocellulose.

37. A propellant composition as in claim 22 wherein said binder selected is nitrocellulose.

38. A propellant composition as in claim 23 wherein said binder selected is nitrocellulose.

39. A propellant composition as in claim 24 wherein said binder selected is nitrocellulose.

40. A propellant composition as in claim 25 wherein said binder selected is nitrocellulose.

41. A propellant composition as in claim 26 wherein said binder selected is nitrocellulose.

42. A propellant composition as in claim 27 wherein said binder selected is nitrocellulose.

43. A propellant composition as in claim 28 wherein said binder selected is nitrocellulose.

44. A propellant composition as in claim 29 wherein said binder selected is nitrocellulose.

45. A propellant composition as in claim 30 wherein said binder selected is nitrocellulose.

46. A propellant composition as in claim 40 wherein said resultant product is the coprecipitate of cesium decahydrodecaborate with potassium nitrate.

47. A propellant composition as in claim 46 wherein said coprecipitate is cesium decahydrodecaborate, approximately 25 parts by weight, and potassium nitrate, approximately 75 parts by weight.

48. A propellant composition as in claim 35 wherein said resultant product is the coprecipitate of cesium decahydrodecaborate with potassium nitrate.

49. A propellant composition as in claim 48 wherein said coprecipitate is cesium decahydrodecaborate, approximately 25 parts by weight, and potassium nitrate, approximately 75 parts by weight.

50. A propellant composition as in claim 37 wherein said resultant product is the coprecipitate of tetramethylammonium decahydrodecaborate with potassium nitrate.

51. A propellant composition as in claim 50 wherein said coprecipitate is tetramethylammonium decahydrodecaborate, approximately 15 parts by weight and potassium nitrate, approximately 85 parts by weight.

52. A propellant composition as in claim 30 wherein said binder contains fluorine and is the copolymer of hexafluoropropylene and vinylidene fluoride, said resultant product is the coprecipitate of cesium decahydrodecaborate with potassium nitrate, and said simple salt selected is potassium decahydrodecaborate.

53. A propellant composition as in claim 52 wherein, by weight, said binder is approximately 25 percent, said coprecipitate is approximately 65 percent, and said simple salt is approximately 10 percent.

* * * * *